US010590687B1

(12) United States Patent
Cifers et al.

(10) Patent No.: US 10,590,687 B1
(45) Date of Patent: Mar. 17, 2020

(54) HINGE-LATCH COMBINATION

(71) Applicant: Luther Cifers, Amelia, VA (US)

(72) Inventors: Luther Cifers, Amelia, VA (US); Matthew Montaruli, Greenville, SC (US); Hans Nutz, Easley, SC (US)

(73) Assignee: Luther Cifers, Amelia, VA (US)

( * ) Notice: Subject to any disclaimer, the term of this patent is extended or adjusted under 35 U.S.C. 154(b) by 0 days.

(21) Appl. No.: 16/030,682

(22) Filed: Jul. 9, 2018

Related U.S. Application Data

(60) Provisional application No. 62/530,294, filed on Jul. 10, 2017.

(51) Int. Cl.

| | |
|---|---|
| ***E05D 7/12*** | (2006.01) |
| ***E05D 11/10*** | (2006.01) |
| ***E05D 7/10*** | (2006.01) |
| *E05D 15/50* | (2006.01) |

(52) U.S. Cl.
CPC ..... *E05D 7/12* (2013.01); *E05D 7/1022* (2013.01); *E05D 7/1061* (2013.01); *E05D 7/1066* (2013.01); *E05D 11/1014* (2013.01); *E05D 7/1077* (2013.01); *E05D 15/50* (2013.01); *E05D 15/505* (2013.01); *E05D 2007/128* (2013.01); *E05Y 2900/132* (2013.01); *E05Y 2900/40* (2013.01); *Y10T 16/528* (2015.01)

(58) Field of Classification Search
CPC ..... E05D 7/12; E05D 7/121; E05D 7/123; E05D 2007/128; E05D 7/1022; E05D 7/10; E05D 7/1016; E05D 7/1061; E05D 7/1066; E05D 7/1077; E05D 15/50; E05D 15/505; F25D 2323/022; Y10T 16/528; Y10T 16/53615
See application file for complete search history.

(56) References Cited

U.S. PATENT DOCUMENTS

| | | | | | |
|---|---|---|---|---|---|
| 114,579 | A | * | 5/1871 | Marston | E05D 15/505 16/371 |
| 479,936 | A | * | 8/1892 | Foster | E05D 15/505 16/231 |
| 935,087 | A | * | 9/1909 | Bloomer | B65F 1/16 162/267 |
| 2,365,378 | A | * | 12/1944 | Benson | E05D 1/04 16/264 |
| 2,656,562 | A | * | 10/1953 | Phillips | E05D 15/50 16/231 |
| 2,799,324 | A | * | 7/1957 | Anderson | A47D 1/008 16/231 |
| 2,926,382 | A | * | 3/1960 | Knese | E05D 7/10 16/261 |
| 3,091,357 | A | * | 5/1963 | Weinhart | A45C 13/005 16/260 |
| 3,805,325 | A | * | 4/1974 | Lee | E05C 19/08 16/262 |
| 3,825,296 | A | * | 7/1974 | Peterson | B60J 3/0208 296/97.13 |
| 3,922,870 | A | * | 12/1975 | Recalde | B63B 35/03 405/166 |

(Continued)

*Primary Examiner* — Jeffrey O'Brien
(74) *Attorney, Agent, or Firm* — Thedford I. Hitaffer; Hitaffer & Hitaffer, PLLC

(57) ABSTRACT

A combination hinge and latch that enables a door, gate or lid to be opened from a latched side and latched from the hinged side to provide more than one point of access for an area behind the door, gate or lid.

6 Claims, 4 Drawing Sheets

(56) References Cited

U.S. PATENT DOCUMENTS 4,613,174 A * 9/1986 Berg ..... B61D 9/12 105/377.05
4,731,903 A * 3/1988 Kennedy ..... E05D 7/1077 16/224
5,381,920 A * 1/1995 Lin ..... B25H 3/02 16/261
5,548,927 A * 8/1996 Song ..... E05D 15/505 49/193
5,675,934 A * 10/1997 Park ..... E05D 15/505 16/232
5,829,197 A * 11/1998 Oh ..... E05D 15/505 49/193
6,000,550 A * 12/1999 Simpson ..... E05D 7/1077 16/257
6,105,809 A * 8/2000 Yamanaka ..... A47J 36/06 16/257
6,890,196 B2 * 5/2005 Vila ..... E05D 1/06 16/257
7,100,786 B2 * 9/2006 Smyers ..... B65D 11/1833 220/6
7,116,559 B2 * 10/2006 Davis, Jr. ..... B60K 37/02 361/740
7,574,773 B2 * 8/2009 Dahl ..... E05D 1/04 16/231
7,761,958 B2 * 7/2010 Alfredsson ..... E05D 7/1061 16/267
8,024,839 B2 * 9/2011 Lewis, II ..... E05D 7/1072 16/266
8,272,101 B2 * 9/2012 Wagner ..... E05D 3/08 16/231
8,656,556 B2 * 2/2014 Bennett ..... B60R 3/02 14/69.5
8,727,165 B2 * 5/2014 Nolan ..... B65D 11/18 16/246
9,664,215 B2 * 5/2017 Laird ..... F16B 2/185
10,260,262 B2 * 4/2019 Jiang ..... E05D 3/02
2007/0089269 A1 * 4/2007 Shen ..... E05D 5/06 16/268
2017/0044809 A1 * 2/2017 Chiste ..... F16G 3/02

* cited by examiner

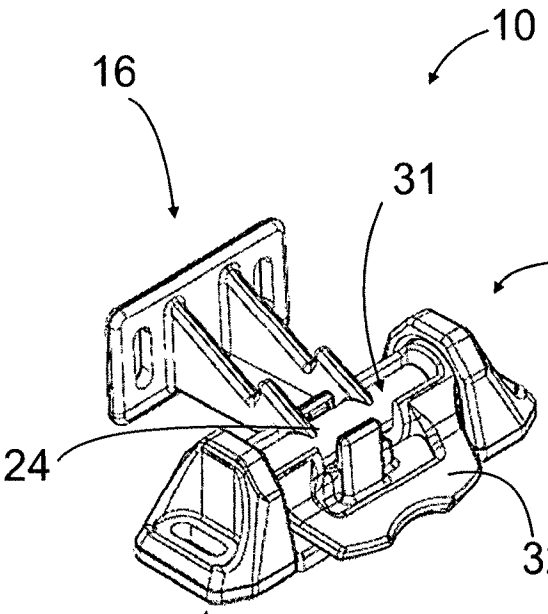
Fig. 7
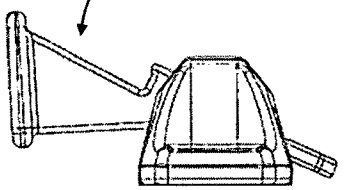
Fig. 8
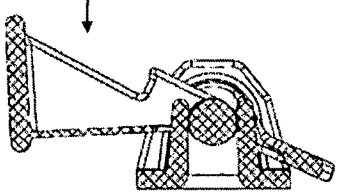
Fig. 9
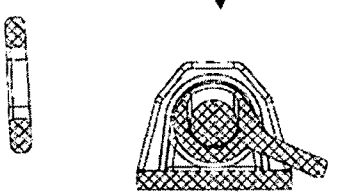
Fig. 10
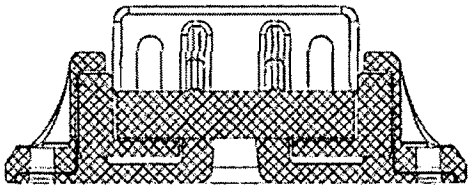
Fig. 11
Fig. 12

HINGE-LATCH COMBINATION

CROSS-REFERENCE TO RELATED APPLICATIONS

This application claims the benefit of U.S. Provisional Application No. 62/530,294, filed Jul. 10, 2017, the disclosure of which is incorporated herein by reference by its entirety.

BACKGROUND OF THE INVENTION

This invention relates in general to latches and hinges. Most particularly, the invention relates to a combination hinge and latch.

Hinges and latches are well known. A hinge is a movable joint on which a door, gate or lid moves or swings when opened and closed, or which otherwise connects objects for movement in relation to one another. A latch is a catch, lever or fastener used for fastening a door, gate or lid. It may be desirable to open a door, gate or lid from a latched side and latch the same from the hinged side.

A combination hinge and latch is needed that enables a door, gate or lid to be opened from a latched side and latched from the hinged side to permit access to an area behind the door, gate or lid from more than one point of access.

SUMMARY OF THE INVENTION

This invention relates to a combination hinge and latch that enables a door, gate or lid to be opened from a latched side and latched from the hinged side to provide more than one point of access for an area behind the door, gate or lid.

Various advantages of this invention will become apparent to those skilled in the art from the following detailed description of the preferred embodiment, when read in light of the accompanying drawings.

BRIEF DESCRIPTION OF THE DRAWINGS

Various features and attendant advantages of the hinge-latch combination will become more fully appreciated when considered in view of the accompanying drawings, in which like reference characters designate the same or similar parts and/or features throughout the several views, and wherein:

FIG. 7 is a front perspective view of the hinge-latch combination, in an unlatched condition;

FIG. 8 is a side elevational view of the hinge-latch combination shown in FIG. 8;

FIG. 9 is a cross-section view of the hinge-latch combination shown in FIG. 8 taken laterally through the center thereof.

FIG. 10 is a cross-section view of the hinge-latch combination.

FIG. 11 is a cross-section view of the hinge-latch combination shown in FIG. 8 taken laterally through the semi-cylindrical member thereof.

FIG. 12 is a cross-section view of the hinge-latch combination shown in FIG. 8 taken longitudinally through the center thereof.

DETAILED DESCRIPTION OF THE PREFERRED EMBODIMENT

It should be noted that orientational terms used throughout this description are with reference to the orientation of the hinge-latch combination and component parts thereof as presented in the accompanying drawings, which is subject to change. Therefore, orientational terms are used for semantic purposes, and do not limit the invention or its component parts in any particular way.

Figures 1, 2, 3, 4, 5, 6:
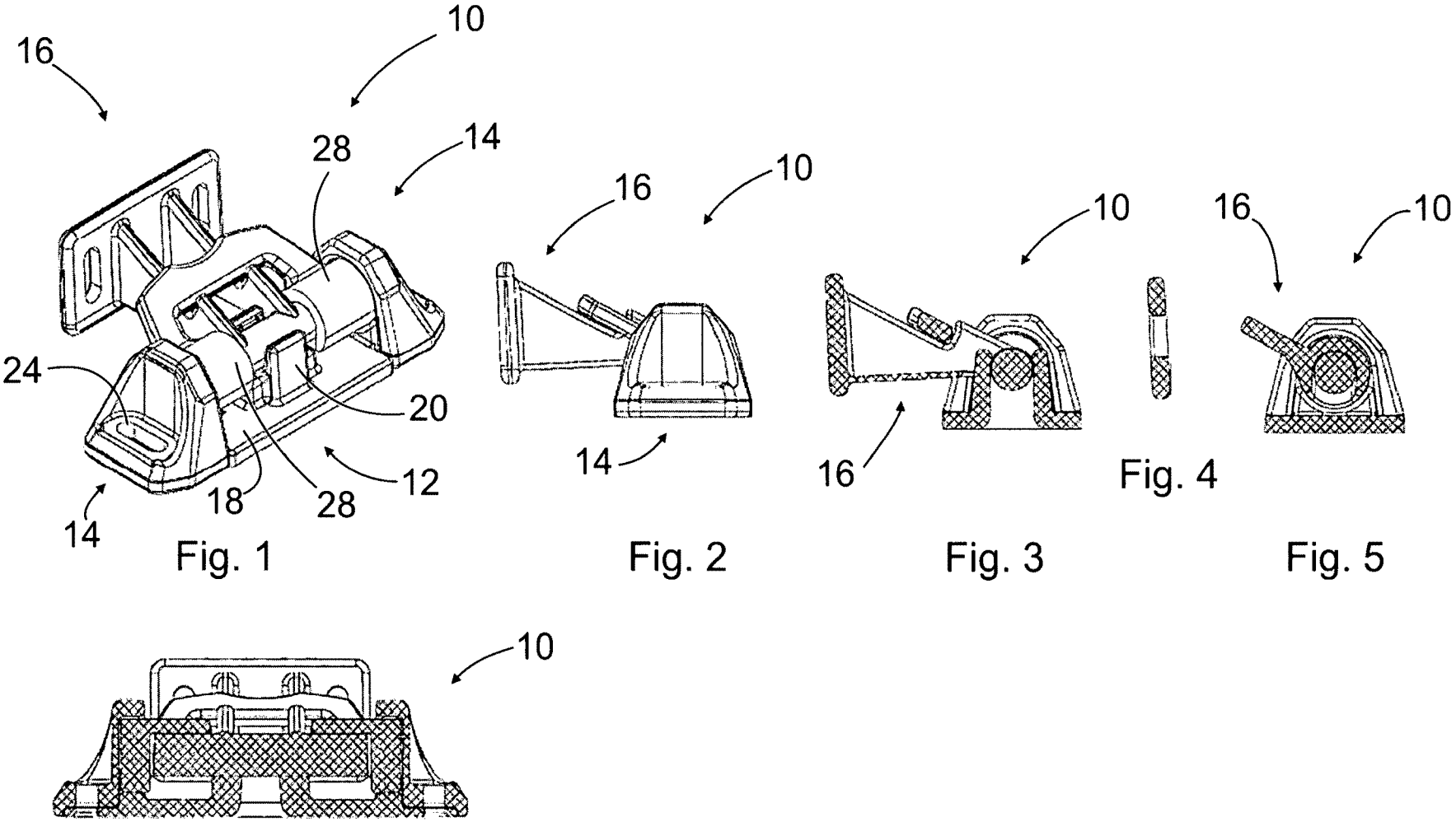
FIG. 1 is a front perspective view of an exemplary hinge-latch combination, in a latched condition.
FIG. 2 is a side elevational view of the hinge-latch combination shown in FIG. 1.
FIG. 3 is a cross-section view of the hinge-latch combination shown in FIG. 1 taken laterally through the center thereof.
FIG. 4 is a cross-section view of the hinge-latch combination.
FIG. 5 is a cross-section view of the hinge-latch combination shown in FIG. 1 taken laterally through the semi-cylindrical member thereof.
FIG. 6 is a cross-section view of the hinge-latch combination shown in FIG. 1 taken longitudinally through the center thereof.
Figures 13, 14, 15, 16, 17, 18:
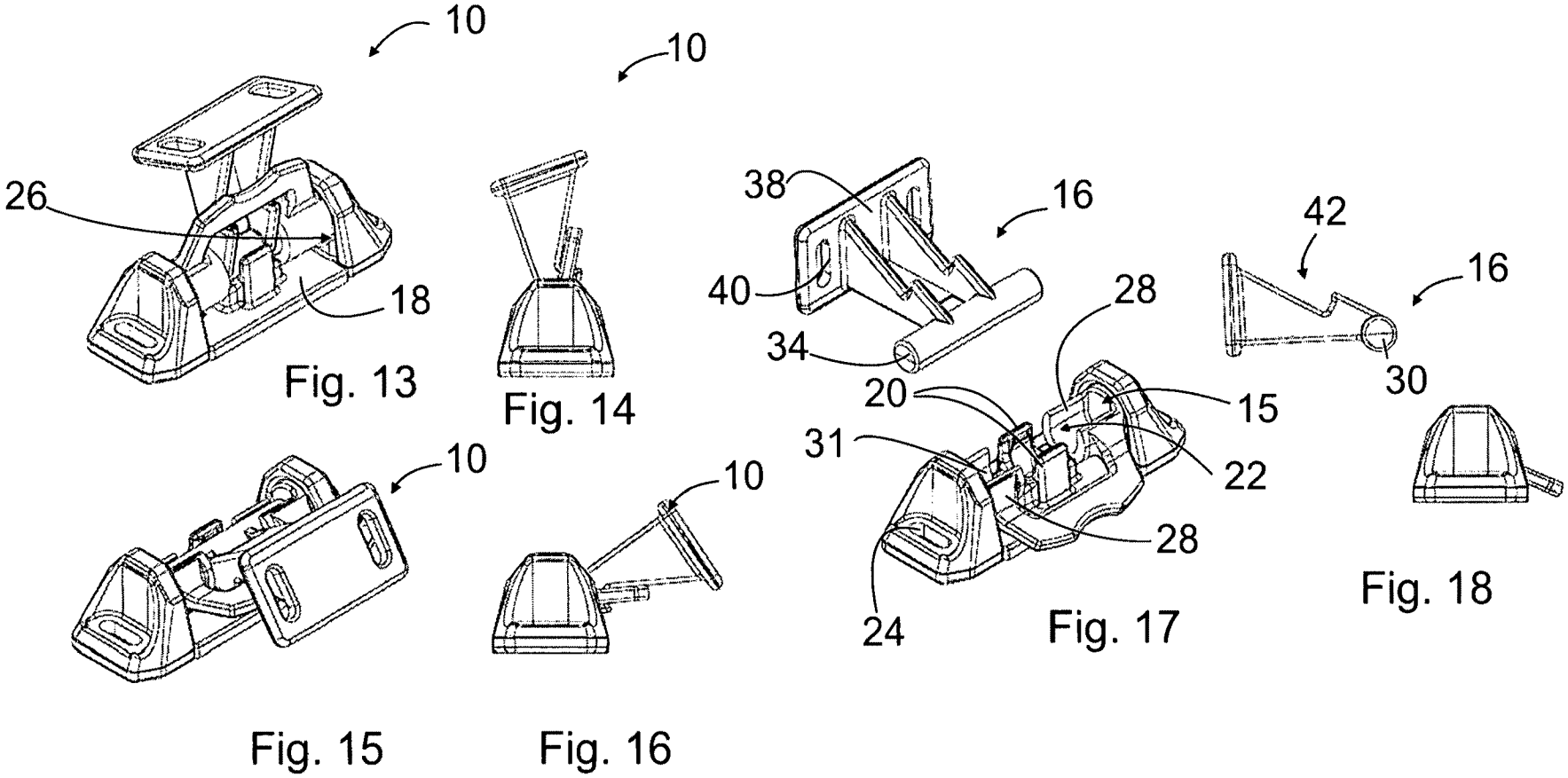
FIG. 13 is a front perspective view of the hinge-latch combination, in a latched condition, in a first position.
FIG. 14 is a side elevational view of the hinge-latch combination shown in FIG. 13.
FIG. 15 is a front perspective view of the hinge-latch combination, in a latched condition, in a second position.
FIG. 16 is a side elevational view of the hinge-latch combination shown in FIG. 15.
FIG. 17 is a front perspective view of the hinge-latch combination, in an unlatched, exploded condition.
FIG. 18 is a side elevational view of the hinge-latch combination shown in FIG. 17.

Referring now to the drawings, there is illustrated a hinge-latch combination 10 comprising a first or lower mount 12, hinge caps 14 disposed on opposing ends of the lower mount 12, a cradle 15 (shown in FIG. 17) supported in relation to the hinge caps 14, and a second or upper mount 16 releasably coupled for hinged movement in relation to the cradle 15.

The lower mount 12 comprises a longitudinally extending base 18 and laterally disposed upwardly extending members 20, together with bridging structure, defining a semi-cylindrical well 22 (shown in FIG. 17) for receiving a corresponding portion of the upper mount 16.

The hinge caps 14 are juxtaposed the lower mount 12. The hinge caps 14 each comprise laterally disposed mounting through slots 24 for receiving fasteners (not shown) for attaching the hinge caps 14, with the lower mount 12 therebetween, to a supporting surface, such as the hull of a watercraft or some other vehicle or structure. The hinge caps 14 each further comprise a cylindrical receptacle, generally at 26 (shown in FIG. 13), which is opposingly disposed to face one another, for receiving a corresponding portion of the cradle 15, to support the cradle 15 for pivotal movement in relation to the hinge caps 14.

The cradle 15 is comprised of two longitudinally disposed semi-cylindrical members 28, longitudinally spaced apart, so that the semi-cylindrical well 22 (shown in FIG. 17) is disposed therebetween. Ends 30 (shown in FIG. 18) of the semi-cylindrical members 28 are inserted for pivotal movement into the cylindrical receptacles 26 of corresponding hinge caps 14. The cradle 15 has a longitudinal opening 31 (shown in FIG. 17) for receiving a corresponding portion of the upper mount 16. The semi-cylindrical members 28 are joined or bridged together in fixed relation to one another via a latch clip 32 (shown in FIG. 7). The latch clip 32 is operable to close the longitudinal opening 31 to retain the corresponding portion of the upper mount 16 in the semi-cylindrical members 28 and the semi-cylindrical well 22 (shown in FIG. 17).

The upper mount 16 comprises a pin 34 (shown in FIG. 17) and is sized and configured to fit snugly for pivotal movement in the semi-cylindrical members 28 and the semi-cylindrical well 22 (shown in FIG. 17) therebetween. Longitudinally spaced legs (shown but not referenced) extend radially from the pin 34. The legs are longitudinally spaced with the semi-cylindrical well 22 therebetween and the semi-cylindrical members 28 are disposed on opposing sides of the legs. A mounting plate 38 (shown in FIG. 17) is supported in relation to the ends of the legs opposite the pin 34. The pin 34, the legs and the mounting plate 38 (shown in FIG. 17) are joined together to form a one-piece unitary construction. The mounting plate 38 is provided with through slots 40 (shown in FIG. 17) for receiving fasteners (not shown) for attaching the mounting plate 38 to a supporting surface, such as a console door or some other structure. Each leg is provided with a detent or relief 42 (shown in FIG. 18) for receiving the latch clip 32 in a snap fit fashion. The latch clip 32 may be dislodged from the relief 42 by applying sufficient force against the latch clip 32. With the latch clip 32 (shown in FIG. 7) dislodged, the cradle 15 (shown in FIG. 17) may be pivoted to expose an opening 31 (shown in FIG. 7), to permit the pin 34 (shown in FIG. 17) to be removed from the cradle 15.

Figure 19:
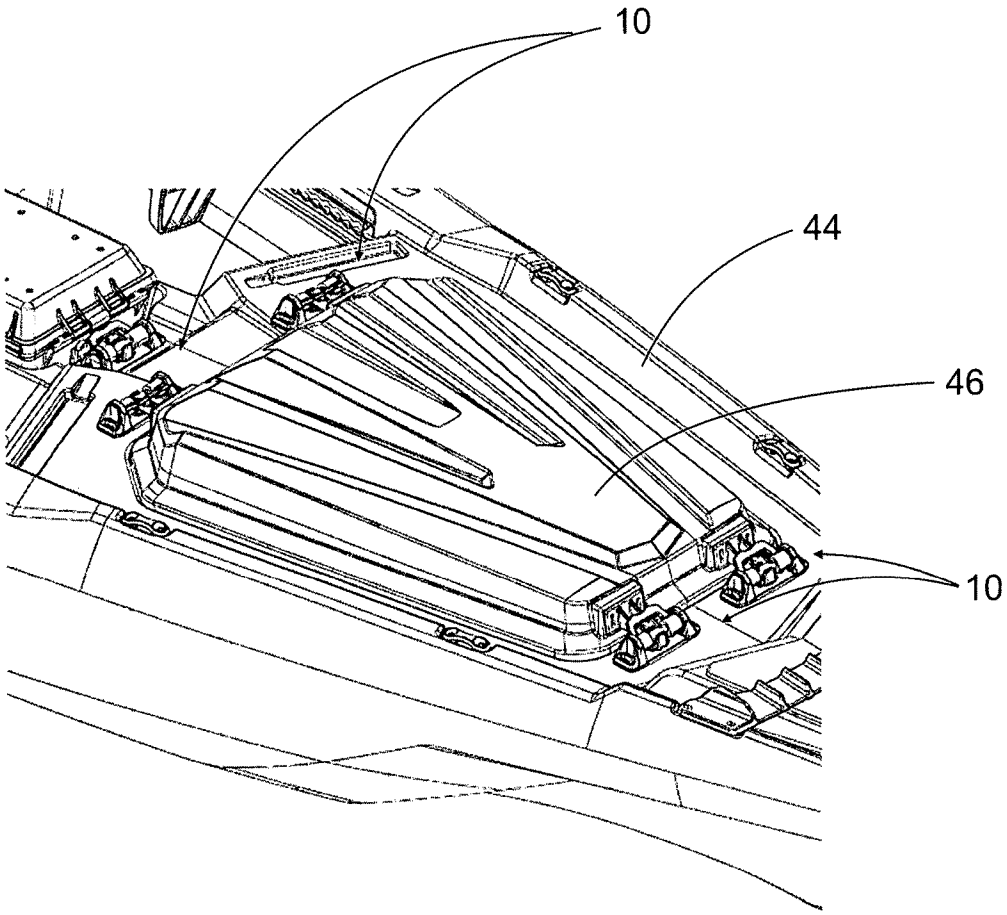
FIG. 19 is an environmental perspective view of the hinge-latch combination.

In operation, the lower mount 12 is attached to a first structure, such as a vehicle, such as the hull of the kayak 44 shown in the drawings (shown in FIG. 19). The mounting plate 38 is attached to a second structure, such as the console door 46 shown. Two spaced apart hinge-latch combinations 10 are provided on one side of the console door 46 to support the console door 46 for pivotal movement along the one side, and two spaced apart hinge-latch combinations 10 are provided on an opposing side of the console door 46 to support the console door 46 for pivotal movement along the opposing side.

With the pin 34 inserted in the semi-cylindrical members 28 and the semi-cylindrical well 22, the latch clip 32 is operable to be received in the relief 42 in a snap fit fashion, to close the longitudinal opening 31 to retain the pin 34 in the semi-cylindrical members 28 and the semi-cylindrical well 22. In this configuration, the hinge-latch combinations 10 function as a hinge and/or a latch. Applying a force sufficient to dislodge the latch clips 32 from the reliefs 42 of the hinge-latch combinations 10 along one side of the console door 46 permits displacement of the semi-cylindrical members 28 to expose the opening 31 to permit the pins 34 of the hinge-latch combinations 10 to be removed therefrom. With the pin 34 removed, the hinge-latch combinations 10 along the one side of the console door 46 function as an unlatched latch. The hinge-latch combinations 10 along the opposing side of the console door 46 function as a hinge, supporting the console door 46 for pivotal movement, to open and close the console door 46. To latch the console door 46 in a closed position, the latch clip 32 is rotated to engage the relief 42. With the latch clip 32 lodged in the relief 42, the pin 34 is again trapped in the cradle 15, thus forming a latched latch.

It should be appreciated that the hinge-latch mechanism may be formed of any suitable material, including, for example, metal, plastic, or other suitable material. Various components thereof may be of solid construction or hollow, or a combination thereof. The same may be cast, cut, molded, extruded or formed in some other suitable manner.

While the hinge-latch mechanism and components parts thereof may have been described herein in terms of certain components being referred to in either the singular or the plural, other arrangements are possible. For example, it is to be understood that due to the conceptual description presented herein, components presented in the singular may be provided in the plural, and vice versa.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A hinge-latch combination comprising:

a lower mount configured to attach to a first structure, the lower mount comprising a longitudinally extending base and laterally disposed upwardly extending members, together with bridging structure, defining a semi-cylindrical well, hinge caps disposed on opposing ends of the lower mount, the hinge caps each comprising a cylindrical receptacle, which are opposingly disposed to face one another, a cradle supported in relation to the hinge caps, the cradle comprising two longitudinally disposed semi-cylindrical members each having an end received by the cylindrical receptacle of a corresponding one of the hinge caps far pivotal movement into the cylindrical receptacle of the corresponding one of the hinge caps, the cradle comprising a longitudinal opening, the semi-cylindrical members being longitudinally spaced apart so that the semi-cylindrical well is disposed therebetween, an upper mount configured to attach to a second structure, releasably coupled for hinged movement in relation to the cradle, the upper mount comprising a pin that is sized and configured to fit snugly for pivotal movement in the semi-cylindrical members and the semi-cylindrical well, and a latch clip joining the semi-cylindrical members, the latch clip being operable to move the longitudinal opening into alignment with the semi-cylindrical well for receiving and removing the pin from the semi-cylindrical members and the semi-cylindrical well and to move the longitudinal opening out of alignment with the semi-cylindrical well for containing the pin in the semi-cylindrical members and the semi-cylindrical well.

2. The hinge-latch combination of claim 1, wherein the upper mount further comprises longitudinally spaced legs that extend radially from the pin, the legs being longitudinally spaced with the semi-cylindrical well between the legs and the semi-cylindrical members being disposed on opposing sides of the legs.

3. The hinge-latch combination of claim 2, wherein the upper mount comprises a mounting plate that is supported in relation to ends of the legs opposite the pin.

4. The hinge-latch combination of claim 3, wherein the pin, the legs and the mounting plate are joined together to form a one-piece unitary construction.

5. The hinge-latch combination of claim 3, wherein the hinge caps and the mounting plate are provided with through slots for receiving fasteners for attaching the hinge caps and the mounting plate to respective supporting surfaces.

6. The hinge-latch combination of claim 2, wherein the legs are provided with a relief for receiving the latch clip in a snap fit fashion, wherein the latch clip is configured to be dislodged from the relief by applying sufficient force against the latch clip, and wherein with the latch clip dislodged, the cradle is configured to be pivoted to expose the longitudinal opening to permit the pin to be removed from the semi-cylindrical members and the semi-cylindrical well.

* * * * *